United States Patent [19]

Faust

[11] 4,040,351

[45] Aug. 9, 1977

[54] MAGNETICALLY HELD PRINTING MAT

[75] Inventor: Hans B. Faust, Mount Prospect, Ill.

[73] Assignee: Weber Marking Systems, Inc., Arlington Heights, Ill.

[21] Appl. No.: 731,848

[22] Filed: Oct. 12, 1976

[51] Int. Cl.[2] ..... B41F 27/02

[52] U.S. Cl. ..... 101/382 MV; 40/142 A; 101/395; 248/206 A

[58] Field of Search ..... 101/382 MV, 401.1, 395; 40/142 A; 248/206 A

[56] References Cited

U.S. PATENT DOCUMENTS

| | | | |
|---|---|---|---|
| 2,982,207 | 5/1961 | Stromme | 101/382 MV |
| 3,566,789 | 3/1971 | Hecht et al. | 101/395 |

*Primary Examiner*—Clyde I. Coughenour
*Attorney, Agent, or Firm*—Kenneth T. Snow

[57] ABSTRACT

The construction of a flexographic printing mat specially shaped to enhance its snug and continued engagement over its full length to a magnetic base cylinder. The flexographic printing mat is made of shim stock steel and is preformed with inverted V-shapes lying parallel to and closely adjacent both of its ends to form closely spaced apart cylinder engaging lines at each end of the mat. The spaced apart line contacts of the mat with the magnetic cylinder act to concentrate the gripping power of the cylinder to securely hold the mat and including its leading and trailing ends to the cylinder.

3 Claims, 3 Drawing Figures

MAGNETICALLY HELD PRINTING MAT

BACKGROUND OF THE INVENTION

1. Field of the Invention

Rotatable printing cylinders have long been in use in the printing field. These rotatable printing cylinders are adapted to have printing mats attached to their outer cylindrical surfaces. The mats are and have been made of many different materials and the means of attaching the mats to the cylinders have taken many forms. Many mats have had their ends bent to form flanges which when disposed radially were adapted to be removably locked or wedged in radially disposed grooves in the surface of the cylinder. It has been a difficult job to mechanically lock a mat in a proper position on a cylinder and when the mats had to be changed frequently the setting up of the mat on the cylinder became almost intolerable.

A substantial breakthrough for easing this situation occurred when printing cylinders were built with permanent magnets in the cylindrical surface to receive and hold printing mats without auxiliary mechanical attaching means. Such magnetic mat attachment worked ideally when the base cylinder was of relatively large diameter. However, with smaller diameter printing cylinders the magnetically attracted mats had a tendency to pull away from the cylinder at their leading and trailing ends.

It is with this as a background that the present inventor developed a sure means for magnetically holding the full length of a printing mat to a cylinder surface regardless of the diameter of that cylinder.

2. Description of the Prior Art

A Preliminary patent search disclosed the following art which was deemed of pertinence to a consideration of patentability.

McWhorter U.S. Pat. No. 2,668,497
Kessler U.S. Pat. No. 2,978,980
Stromme U.S. Pat. No. 2,982,207
Willard U.S. Pat. No. 3.006,277
McKay U.S. Pat. No. 3,180,259
Wessels U.S. Pat. No. 3,587,464
Jenkins U.S. Pat. No. 3,885,497
Jenkins U.S. Pat. No. 3,885,498
Saunders et al U.S. Pat. No. 3,934,509

The patents to McWhorter, Kessler, Wessels and Saunders et al all show various mechanical means for attaching a printing plate to a cylinder and no one of them uses any magnetic means in such attachment. These prior patents were believed to be pertinent in that the flexible printing plates shown therein have variously formed ends to facilitate the attachment of the plates to the cylinders. For example, the McWhorter patent shows and described undercut grooves 31 and 32 extending transversely near the lead- and trailing ends of a flexible plate. However, such undercut grooves do not aid in the magnetic holding of a flexible printing plate to a cylinder.

The Willard patent shows an inflatable means for locking a printing mat to a cylinder, but again there is no magnetic gripping means involved in this device.

The two Jenkins patents describe cylinder constructions with magnets incorporated therein. These Jenkins cylinders are provided with radial grooves to receive a slightly bent end of the flexible printing plates, P. The engagement of the bent end of the leading edge of the printing plate with the radial cylinder groove 21 has the stated purpose of preventing the plate from creeping around the cylinder. This is quite different from applicant's construction which is concerned only with a smooth surface, non-grooved magnetic cylinder.

The McKay patent shows another form of magnetic cylinder construction. However, there does not appear to be any similarity between the attaching means of this McKay patent and applicant's device.

The Stromme patent shows a printing plate, which is corrugated throughout its length. The Stromme plate is stated to be flexible and adheres to a magnetized cylinder. However, such a fully corrugated cylinder is not too feasible for the reception of type or other printing elements on the surface thereof because of its sawtooth surface. If fillers were used to level the V-grooves to receive type on a flat surface, a considerable amount of the plate's flexibility would be lost and the plate would be very costly to produce. There appears to be a great difference between this Stromme device and applicant's device.

Nowhere in this mass of prior art is there any teaching of applicant's invention.

SUMMARY OF THE INVENTION

A principal object of the present invention is to provide a novel flexible printing mat which is securely magnetically adhered to a base cylinder throughout its full length.

An important object of this invention is to provide novel means for enhancing the magnetic gripping attachment of a flexible steel shim stock printing plate to a magnetic base cylinder.

Another important object of this invention is to provide a novel shaping of a flexible steel shim stock printing plate in a manner to concentrate the magnetic gripping of the ends of the plate to a magnetic base cylinder.

Still another important object of this invention is to provide a novel shaping of the ends of a flexible printing plate to form spaced apart transverse lines disposed closely adjacent the leading and trailing ends of the mat to thereby increase the degree of attraction between the ends of the mat and a base magnetic cylinder.

Another and still further important object of this invention is to provide a novel rectangularly shaped flexible printing mat preformed with transversely extending V-shapes located close to and generally parallel with each end of the mat to create spaced apart magnetic gripping lines which tend to concentrate the effective magnetic attraction of the mat to a magnetic base cylinder.

A still further important object of this invention is to provide a device of the previous object in which the novel V-shapes act as hinges between the defined short ends of the mat and the full body of the mat between the V-shapes to thereby avoid a direct pull away of the ends of the mat from the magnetic cylinder on which the mat is mounted.

Other and further important objects and advantages will become apparent from the disclosures in the following specification and accompanying drawings.

IN THE DRAWINGS

AS SHOWN IN THE DRAWINGS

Figure 1:
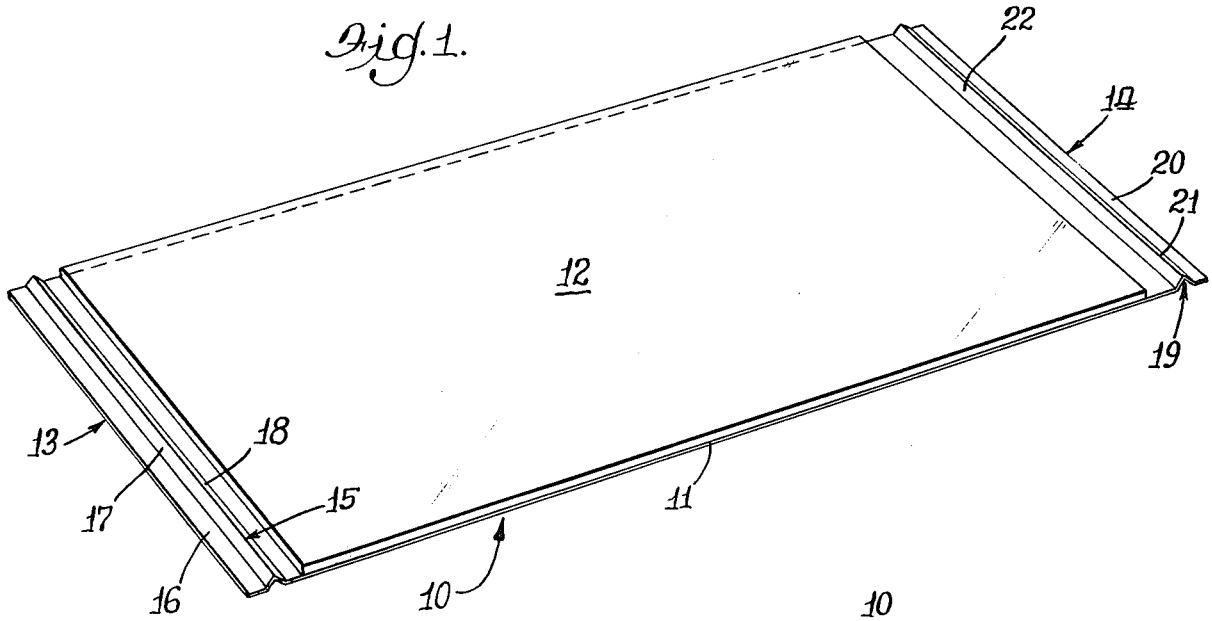
FIG. 1 is a perspective view of the specially formed flexographic printing mat of this invention.
Figure 2:
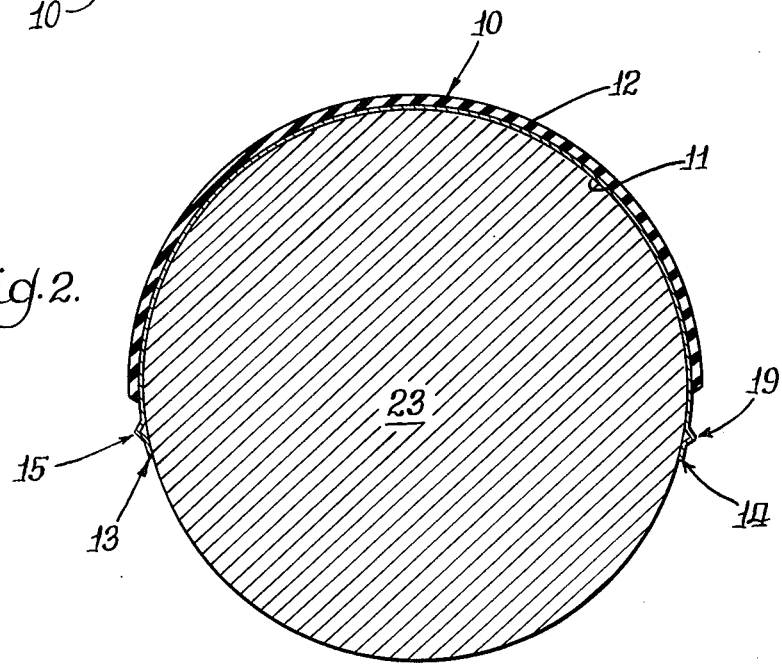
FIG. 2 is a transverse sectional view of a magnetic printing cylinder with the flexographic printing mat of FIG. 1 mounted therearound.

The reference numeral 10 indicates generally a printing mat which is used in combination with a cylinder in a printing press to effect transfer of the indicia content of the mat to a receiving surface. The printing mat 10 includes a thin, flexible sheet steel base 11. One example of an acceptable thin steel base is 0.006 inch shim stock steel. A somewhat shorter but similar width rubber sheet is cemented or otherwise fastened to the base steel 11 at a position substantially centrally between the ends of the steel base 11.

The combination steel and rubber mat 10 when placed on and over a printing cylinder has a leading end 13 and a trailing end 14. In the mat shown these ends 13 and 14 are identical to each other. Closely adjacent the leading end 13 of the mat the thin steel base 11 is provided with a V-form or shape 15. This V-form is struck up from the sheet steel to insure that there is no interference with a smooth under surface of the entire mat 10. The V-form 15 defines a short flat end portion 16, an upwardly angled portion 17, and thence a downwardly inclined angled portion 18.

Closely adjacent the trailing end 14 of the mat 10 the thin steel base 11 is provided with a V-form or shape 19. This V-form 19 is identical to the V-form at the leading end of the mat and includes a short flat end portion 20, an upwardly angled portion 21, and thence an adjoining downwardly angled portion 22.

The mat 10 is adapted to be magnetically adhered to a base cylinder 23 which is preferably equipped with a permanent magnet which is effective on the surface thereof. The highly flexible mat 10 has its steel base 11 magnetically attracted to the surface of the cylinder 23.

Figure 3:
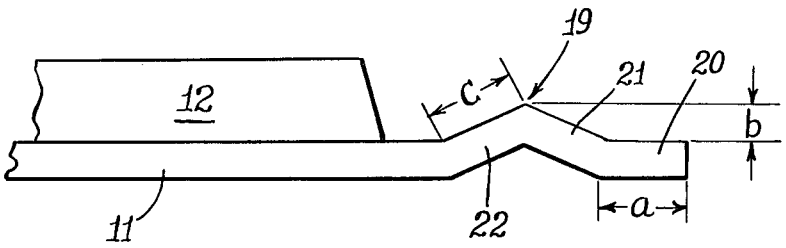
FIG. 3 is an enlarged detail of a side elevational view of a portion of one end of the printing mat of this invention showing a V-form running transversely of the mat and closely adjacent the end.

FIG. 3 best discloses the V-shapes 15 and 19 formed in the ends of the mat 10. The form shown in FIG. 3 is actually that of the trailing end 14 but it should be understood it is identical to the V-form adjacent the leading end 13 and hence is representative of both V-forms. The short flat end portions 16 and 20 are of a length designated by the dimension "a" in FIG. 3. The height of inclination of the angled portions 17 and 18 and 21 and 22 is designated by the dimension "b" in FIG. 3. The length of the inclined portions 17 and 18 and 21 and 22 is designated by the dimension "c" in FIG. 3.

Tests have shown that an acceptable length of dimension "a" is one-eighth inch but it should be understood this dimension could be varied throughout a substantial range without hindering operation of the device of this invention. An acceptable height for the V-forms 15 and 19 is 0.060 inch which is substantially less than the height of the rubber pad 12 from which the printing is transferred. Thus the upwardly struck V-forms do not interfere with the transfer of print from the rubber portion 12 of the mat 10. Similarly it has been found that a good dimension for the length of the angled portions of dimension "c" is approximately ⅛ inch.

The transverse V-forms in the steel mat act as hinge-like elements about which the short ends 16 and 20 of the mat may remain fixed to the magnetic cylinder 23 without any tendency for the mat to pull loose at those ends. The V-forms also provide two closely spaced apart transverse magnetic gripping lines which act to concentrate the magnetic attraction of the mat to the cylinder and thus avoid any tendency for the mat to peel upwardly at its ends.

OPERATION OF THE DEVICE

The magnetic printing cylinder 23 used with the printing mat of this invention is of relatively small diameter. The mat 10 to be mounted on the cylinder is much smaller than the customary full size printer. In the present instance the printer was primarily designed for labels or addressing which basically is smaller than letter size paper for which most printers are made. As the printing cylinder is smaller and has a smaller diameter the wrapping of a printing mat thereover produces a more severe angle with a tendency for the mat to pull loose at its ends. As stated in the opening portion of this specification this tendency of the ends of a printing mat to pull away from the surface of a magnetic cylinder is much greater with the smaller diameter cylinder than with the larger diameter cylinders. However, the inventive feature works equally well on the larger size printers and enhances the gripping of the printing mat to the magnetic base cylinder.

The V-shapes 15 and 19 in the shim stock steel base act as deterrents to the separation of the mat from the cylinder. The reason for the greater holding power of a steel mat which is preformed with the upwardly struck V-forms closely adjacent both leading and trailing ends of such a mat is not absolutely certain. However, it is the inventor's belief that the V-forms in effect provide hinges between the short end portions 16 and 20 and the central major body portion of the mat lying between those V-forms. The permitted flexing of the mat at its ends breaks the uninterrupted tendency of the mat to swing upwardly away from the base magnetic cylinder. Also, the spaced apart magnetic line contacts of the mat on both sides of both V-forms tends to concentrate the magnetic attraction of the mat to the cylinder 23 and again tends to resist the pulling away of the ends 13 and 14 of the mat from the cylinder.

Obviously the use of a magnetically attractive mat of the flexographic type with a magnetic base printing cylinder permits easy mounting of the mat in any desired "set-up" on the cylinder and including easy changing of mats or the relocating of such mats. The excluding of mechanical jaws and the like to cause gripping of a mat gives the magnetically attracted mat greater desirability from both mounting and use standpoints. Now, with the present inventive means to positively grip even the leading and trailing ends of a mat on a small diameter cylinder the saving of labor and time in set up is greatly enhanced.

I am aware that numerous details of construction may be varied throughout a wide range without departing from the principles disclosed herein and I therefore do not propose limiting the patent granted hereon otherwise than as necessitated by the appended claims.

What is claimed is:

1. In a printing device of the type employing a magnetic cylinder comprising a generally rectangularly shaped flexographic printing mat of a flat plane sheet steel adapted to be wrapped around said cylinder and gripped thereto by the magnetic attraction of the cylinder, and the leading and trailing ends only of said flexographic printing mat being preformed with an inverted V-shape lying parallel to and closely adjacent each end thereof and leaving an intermediate flat portion on the mat whereby the resultant spaced apart parallel engagement lines at the ends of the flexographic printing mat created by the inverted V-shapes cause a more concentrated magnetic adherence of the ends of the mat to the magnetic cylinder over the intermediate flat portion of the mat thereby preventing unwarranted separation of the mat from the cylinder.

2. A device as set forth in claim 1 in which the printing mat includes a type element attached thereto on the intermediate flat portion between its ends, and the radial height of the inverted V-shapes in the mat being less than the radial height of the type element when the printing mat is magnetically snuggly attached over its full length to said cylinder.

3. A device as set forth in claim 1 in which the flat plane sheet steel flexographic printing mat is in the order of 0.006 inch thick and the height of the inverted V-shape is in the order of 0.060 inch.

* * * * *